US005567912A

United States Patent [19]

Manning et al.

[11] Patent Number: 5,567,912

[45] Date of Patent: Oct. 22, 1996

[54] INSENSITIVE ENERGETIC COMPOSITIONS, AND RELATED ARTICLES AND SYSTEMS AND PROCESSES

[75] Inventors: Thelma G. Manning, Montville; Joseph Turci, Long Valley, both of N.J.; Mark J. Mezger, Mt. Bethel, Pa.; Bernard Strauss, Rockaway, N.J.

[73] Assignee: The United States of America as represented by the Secretary of the Army, Washington, D.C.

[21] Appl. No.: 322,863

[22] Filed: Oct. 11, 1994

Related U.S. Application Data

[63] Continuation-in-part of Ser. No. 983,954, Dec. 1, 1992, abandoned.

[51] Int. Cl.[6] ..... C06B 45/24

[52] U.S. Cl. ..... 149/12; 149/11

[58] Field of Search ..... 149/11, 12, 93

[56] References Cited

U.S. PATENT DOCUMENTS

| | | | |
|---|---|---|---|
| 3,679,781 | 7/1972 | Olson et al. | 264/3 R |
| 4,102,953 | 7/1978 | Johnson et al. | 264/3 |
| 4,775,432 | 10/1988 | Kokonko et al. | 149/19.4 |
| 4,842,659 | 6/1989 | Mezger et al. | 149/19.2 |
| 4,853,051 | 8/1989 | Bennett et al. | 149/19.4 |
| 5,174,837 | 12/1992 | Boileau et al. | 149/19.91 |
| 5,240,523 | 8/1993 | Willer | 149/14.4 |
| 5,325,782 | 7/1994 | Strauss et al. | 102/285 |

OTHER PUBLICATIONS

R. L. Simmons, Propellant Ingredient Research, Air Force Armanent Lab (DLJG), Eglin Air Force Base, FL 32542, May 1984, Final Report, Contract No. F086–82–0383, Report Number AFATL–TR–84–51: Table of Contents pages 1, 2, 7, 8, 12–15, 28, 31–37, 50–56, 60–61, 71–75, 78–81,83,90–92, 112, 113, 139, 146, & 151.

*Primary Examiner*—Donald P. Walsh
*Assistant Examiner*—Anthony R. Chi
*Attorney, Agent, or Firm*—Anthony T. Lane; Edward Goldberg; John E. Callaghan

[57] ABSTRACT

The invention is an insensitive energetic composition that is an explosive and the related articles and systems. The composition has HMX or RDX as an energetic filler, a nonenergetic binder and an energetic plasticizer. The plasticizer is a nitrato-nitramine or a liquid nitrate ester. This provides a matrix with a glass transition temperature below minus 45 degrees Centigrade. In another variation, the composition can also include aluminum powder. Generally, the materials have particularly strong blast effects.

2 Claims, 7 Drawing Sheets

| INGREDIENTS | PAX-2A | 5 | 6 | 7 | 8 | 9 | 10 |
|---|---|---|---|---|---|---|---|
| HMX | 85 | 85 | 85 | 85 | 85 | 85 | 85 |
| CAB | 6 | 6 | 6 | 6 | 5 | 6 | 6 |
| NC(12.6%) NITROCELLULOSE | | | | | 1 | | |
| BDNPA/F | 9 | | | | | | |
| METHYL NENA | | | 4.5 | | | | |
| ETHYL NENA | | 9 | 4.5 | 9 | 6 | 4.5 | |
| BUTYL NENA | | | | | 3 | 4.5 | 9 |
| LICA-12 NEOALKOXY TITANATE | 0.5 | | | | | | |
| EC ETHYL CENTRALITE | | | | | 0.1 | | |
| CAB-O-SIL | | 0.5 | 0.5 | 0.5 | 0.4 | 0.5 | 0.5 |
| | | | | | | | |
| ρ, (g/cc) | 1.783 | 1.753 | 1.777 | 1.77 | 1.778 | 1.761 | 1.753 |
| D (M/SEC) TIGER | 8584 | 8513 | 8611 | 8583 | 8560 | 8546 | 8512 |
| P (KATM) TIGER | 325 | 314 | 326 | 323 | 325 | 18 | 314 |
| ρΔE2v (CAL/CC) TIGER | 1648 | 1604 | 1657 | 1642 | 1632 | 1622 | 1604 |
| ρΔE3v (CAL/CC) TIGER | 1948 | 1902 | 1960 | 1944 | 1632 | 1922 | 1902 |
| ρΔE5v (CAL/CC) TIGER | 2148 | 2100 | 2161 | 2144 | tbd | 2121 | 2100 |
| ρΔE7v (CAL/CC) TIGER | 2227 | 2180 | 2242 | 2224 | tbd | 2201 | 2179 |
| | | | | | | | |
| PROCESSABILITY | 10 | 8 | 7 | 7 | 7 | 7 | 7 |
| IMPACT SENSITIVITY,CM | 82 | 79 | 75 | 74 | 74 | 72 | 73 |
| SYMPATHETIC DETONATION | 1/4 | 1/4 | 1/4 | 1/4 | 1/4 | 1/4 | 1/4 |

NOTE: NENA FORMULATIONS ARE ALL STABLE BASED ON DTA TESTING
ALL DENSITIES ARE AT THE THEORETICAL MAXIMUM .

P(KATM)= DETONATION PRESSURE IN THOUSAND ATMOSPHERES.
ρΔEv = ENERGY DENSITY IN CAL/CC AT N-FOLD EXPANSION FROM THE INITIAL VOLUME. A MEASURE OF THE ABILITY OF THE EXPLOSIVE TO DO WORK.

FIGURE 1

| INGREDIENTS | PERCENT BY WEIGHT | | | | |
|---|---|---|---|---|---|
| | PAX-2A | 1 | 2 | 3 | 4 |
| HMX | 85 | | | | |
| RDX | | 85 | 85 | 85 | 85 |
| CAB | 6 | 7.5 | 7.5 | 7.5 | 7.5 |
| BDNPA/F | 9 | | | | |
| TMETN | | | 5.5 | 7.3 | 3.7 |
| TEGDN | | 9 | 5.5 | 3.7 | 7.3 |
| CAB-O-SIL | 0.5 | | 0.25 | 0.25 | 0.25 |
| EPON-828 | | | 0.25 | 0.25 | 0.25 |
| | | | | | |
| PROCESSABILITY* | 10 | 5 | 8 | 8 | 8 |
| | 82 | 66 | 91 | 85 | 86 |
| | 1/4 | 1/4 | 0/4 | 0/4 | 0/4 |

*PROCESSABILITY RATINGS:
10=EXCELLENT PROCESSING
9= VERY GOOD
8 = GOOD
7 = ADEQUATE
1-6 = BELOW SATISFACTORY

FIGURE 2

| INGREDIENTS | PAX-2A | 5 | 6 | 7 | 8 | 9 | 10 |
|---|---|---|---|---|---|---|---|
| HMX | 85 | 85 | 85 | 85 | 85 | 85 | 85 |
| CAB | 6 | 6 | 6 | 6 | 5 | 6 | 6 |
| NC(12.6%) NITROCELLULOSE | | | | | 1 | | |
| BDNPA/F | 9 | | | | | | |
| METHYL NENA | | | 4.5 | | | | |
| ETHYL NENA | | 9 | 4.5 | 9 | 6 | 4.5 | |
| BUTYL NENA | | | | | 3 | 4.5 | 9 |
| LICA-12 NEOALKOXY TITANATE | 0.5 | | | | | | |
| EC ETHYL CENTRALITE | | | | | 0.1 | | |
| CAB-O-SIL | | 0.5 | 0.5 | 0.5 | 0.4 | 0.5 | 0.5 |
| | | | | | | | |
| ρ, (g/cc) | 1.783 | 1.753 | 1.777 | 1.77 | 1.778 | 1.761 | 1.753 |
| D (M/SEC) TIGER | 8584 | 8513 | 8611 | 8583 | 8560 | 8546 | 8512 |
| P (KATM) TIGER | 325 | 314 | 326 | 323 | 325 | 18 | 314 |
| ρΔE2v (CAL/CC) TIGER | 1648 | 1604 | 1657 | 1642 | 1632 | 1622 | 1604 |
| ρΔE3v (CAL/CC) TIGER | 1948 | 1902 | 1960 | 1944 | 1632 | 1922 | 1902 |
| ρΔE5v (CAL/CC) TIGER | 2148 | 2100 | 2161 | 2144 | tbd | 2121 | 2100 |
| ρΔE7v (CAL/CC) TIGER | 2227 | 2180 | 2242 | 2224 | tbd | 2201 | 2179 |
| | | | | | | | |
| PROCESSABILITY | 10 | 8 | 7 | 7 | 7 | 7 | 7 |
| IMPACT SENSITIVITY,CM | 82 | 79 | 75 | 74 | 74 | 72 | 73 |
| SYMPATHETIC DETONATION | 1/4 | 1/4 | 1/4 | 1/4 | 1/4 | 1/4 | 1/4 |

NOTE: NENA FORMULATIONS ARE ALL STABLE BASED ON DTA TESTING
ALL DENSITIES ARE AT THE THEORETICAL MAXIMUM .

P(KATM)= DETONATION PRESSURE IN THOUSAND ATMOSPHERES.
ρΔEv = ENERGY DENSITY IN CAL/CC AT N-FOLD EXPANSION FROM THE INITIAL VOLUME. A MEASURE OF THE ABILITY OF THE EXPLOSIVE TO DO WORK.

FIGURE 3

| INGREDIENTS | | | | LOT NO. | | | | | | |
|---|---|---|---|---|---|---|---|---|---|---|
| | PAX-2A | 12* | 13 | 14 | 15* | 16 | 17* | 18* | 19 |
| HMX | 85 | 85 | 85 | 85 | 85 | 85 | 85 | 85 | 85 |
| CAB | 6 | 7.5 | 6 | 6 | 6 | 6 | 6 | 5 | 6 |
| NC(12.6%) | | | | | | | | 1 | |
| BDNPA/F | 9 | | | | | | | | |
| TEGDN | | 5.5 | 4.5 | 5.5 | 5.5 | 10 | | | |
| DEGDN | | | 4.5 | | 5.5 | | 12 | 12 | |
| TMETN/BTTN | | 5.5 | | 5.5 | | | | | /9 |
| CAB-O-SIL | | 0.25 | 0.5 | | 0.25 | 0.25 | | 0.25 | 0.25 |
| EPON 828 | | 0.25 | | | 0.25 | 0.25 | | 0.25 | 0.25 |
| EC | | | | | | | | 0.1 | |
| PROCESSABILITY | 10 | 8 | 10 | 9 | 10 | 10 | 9 | 10 | 7 |
| IMPACT SENSITIVITY | 80 | 80 | 85 | 81 | 85 | 84 | 86 | 86 | 81 |
| SYMPATHETIC DETONATION | 1/4 | 1/4 | 1/4 | 1/4 | 1/4 | 1/4 | 1/4 | 1/4 | 1/4 |

NOTE: ALL FORMULATIONS ARE STABLE ON DTA TESTING.

PROCESSABILITY RATINGS:

10 = EXCELLENT 8 = GOOD 1-6 = BELOW SATISFACTORY

9 = VERY GOOD

FIGURE 3A

| INGREDIENTS | | LOT NO. | | | | | | | | |
|---|---|---|---|---|---|---|---|---|---|---|
| | | PAX-2A | 12* | 13 | 14 | 15* | 16 | 17* | 18* | 19 |
| ρ, | (g/cc) | 1.783 | 1.763 | 1.777 | 1.763 | 1.772 | 1.78 | 1.781 | 1.78 | 1.765 |
| D | (M/SEC) TIGER | 8584 | 8496 | 8576 | 8496 | 8552 | 8594 | 8595 | 8594 | 8495 |
| P | (KATM) TIGER | 325 | 316 | 324 | 316 | 322 | 328 | 327 | 326 | 323 |
| ρΔE2v | (CAL/CC) TIGER | 1648 | 1608 | 1645 | 1608 | 1638 | 1659 | 1658 | 1657 | 1607 |
| ρΔE3v | (CAL/CC) TIGER | 1948 | 1904 | 1946 | 1904 | 1938 | 1962 | 1960 | 1959 | 1902 |
| ρΔE5v | (CAL/CC) TIGER | 2148 | 2102 | 2146 | 2102 | 2139 | 2162 | 2161 | 2169 | 2100 |
| ρΔE7v | (CAL/CC) TIGER | 2227 | 2182 | 2226 | 2181 | 2219 | 2244 | 2242 | 2240 | 2179 |

*NOTE:

COMPOSITIONS INCORPORATING MIXED NITRATE ESTERS EXPERIENCE HIGHER LINE LOSSES DURING FABRICATION THAN THEIR BDNPA/F AND NENA COUNTERPARTS. THUS, CALCULATIONS ARE BASED ON PROJECTED FINAL ANALYSES.

FIGURE 4

| | | 4'-1 | 4'-2 | 4'-3 | 4'-4 | 4'-5 | 4'-6 | 4'-7 | 4'-8 | 4'-9 |
|---|---|---|---|---|---|---|---|---|---|---|
| | | | | | | | | | | |
| CAB | | 6 | 6 | 6 | 6 | 6 | 6 | 6 | 6 | 6 |
| BDNPA/F | | 9 | | | | | | | | |
| ETHYL NENA | | | | | | 9 | | | | |
| TMETN | | | | | 5.5 | | | | | |
| TEGDN | | | 9 | | 5.5 | | | 6 | | 5.5 |
| DEGDN | | | | 9 | | | | | 9 | 5.5 |
| ATEC | | | | | | | 8 | 1 | | |
| EPOXY | | | 0.25 | | 0.25 | | | | | |
| | | | | | | | | | | |
| GLASS TRANSITION DATA* (DEGREES CENTIGRADE) | | | | | | | | | | |
| UPPER | | -22 | -51 | -58 | -54 | -68 | -20 | -33 | -69 | -70 |
| MIDPOINT | | -32 | -73 | -71 | -74 | -71 | -43 | -41 | -72 | -73 |
| LOWER | | -37 | -76 | -77 | -78 | -78 | -56 | -44 | -80 | -81 |
| * MIDPOINT IS USED AS Tg | | | | | | | | | | |

FIGURE 5B

| DEG.C | %Methyl/Nena |
|---|---|
| 5 | 0 |
| 0 | 10 |
| -9 | 20 |
| -11 | 30 |
| -9 | 33 |
| 0 | 50 |
| 12 | 68 |
| 38 | 100 |

INSENSITIVE ENERGETIC COMPOSITIONS, AND RELATED ARTICLES AND SYSTEMS AND PROCESSES

STATEMENT OF GOVERNMENT INTEREST

The invention described herein may be manufactured, used and licensed by nor for the United States Government for governmental purposes without the payment to us of any royalties thereon.

STATEMENT OF PARENT APPLICATION

This application is a continuation-in part of Ser. No. 07/983,954, now abandoned, Dec. 1, 1992.

BACKGROUND OF INVENTION

This invention relates to insensitive energetic compositions that are useful as explosives in munitions. Energetic compositions as a class are, broadly, those materials which have high impetus, energy per unit mass, and can be used in explosive, propellant, ignition and fuze applications. For the explosive applications, the materials need high detonation velocity and high energy output and are desirably stable or insensitive under a variety of circumstances. A present insensitive energetic composition for use in explosives has been based on compositions of RDX or HMX, a cellulose ester binder and an energetic plasticizer of BDNPA/F. This has high explosive energy per unit mass and has a low susceptibility to sympathetic detonation. It is considered to be an insensitive munition. There are certain difficulties in the production processes used for the BDNPA/F and other reasons as well make it desirable to develop other insensitive energetic compositions and to provide insensitive munitions incorporating these compositions. Also, it is desirable to extend the range of field conditions in which insensitive explosives may be stored and utilized. The present invention is an improvement in this field and is directed to a novel class of insensitive munitions that are explosives. The explosives are used in military applications such as ammunitions and the associated ammunition handling and storage systems and in weapons and in weapon systems. The insensitive munitions of the invention can also be used in civilian applications such as oil-field fracturing, mining, ice breaking and the like. They are particularly useful in very cold climates or arctic conditions as well as deserts and other hot climates.

In comparison with an application where the need is for propulsion, the explosive application requires very short reaction times. While there are certain similarities between the use of a composition for an explosive application and a propellant application, each of these applications have their own specific technical criteria. One major distinction is that an explosive needs very, very rapid reaction times while a propellant needs a much slower reaction time. Both chemical composition and physical factors such as burning surface, shape, grain geometry, and mechanical integrity of fabricated articles affect whether a composition will be useful as an explosive.

SUMMARY OF INVENTION AND FIGURES

The invention is a chemical composition and the processes of using this composition in articles adapted for explosive devices and the articles, the weapons and the which have elements that contain the insensitive energetic compositions. The insensitve energetic composition is in the form of clusters of coated powder. The powder is a crystalline heterocylic nitramine selected from HMX and RDX and this is an energetic filler. The coating is a combination of a normally solid cellulose ester binder and an energetic plasticizer. The plasticizer is a liquid nitrate ester or a nitrato nitramine selected from methyl Nena, ethyl Nena, and butyl Nena. The coating is a matrix for the energetic filler and the matrix has a glass transition temperature of less than minus 45 degrees Centigrade. The energetic filler is at least about 85% by weight. In another form, the energetic composition includes a coating of aluminum powder on the clusters. In this form, there may be about 1 to 40 per cent by weight of aluminum and, correspondingly, about 99 to 60 per cent by weight of insensitive energetic composition.

The Figures illustrate several aspects of the invention. Generally, FIGS. 1–5 illustrate the effects from variations in the proportions and the chemical components of the insensitive energetic compositions on the various properties of interest in the preparation and use of the compositions as explosives. In the Figures, FIG. 1 illustrates physical and chemical properties for energetic compositions that can be achieved by the invention; the energetic filler is RDX and the nitrato nitramine energetic plasticizers are used.

FIG. 2 shows similar properties for the insensitive compositions which used the nitrato nitramine plasticizers.

FIG. 3 illustrates the application of the invention to compositions which use HMX as the energetic filler and the nitrato-nitramines as the energetic plasticizers.

FIG. 4 illustrates the low glass transition temperatures of the matrix materials which are used in the invention.

Figure 5A:
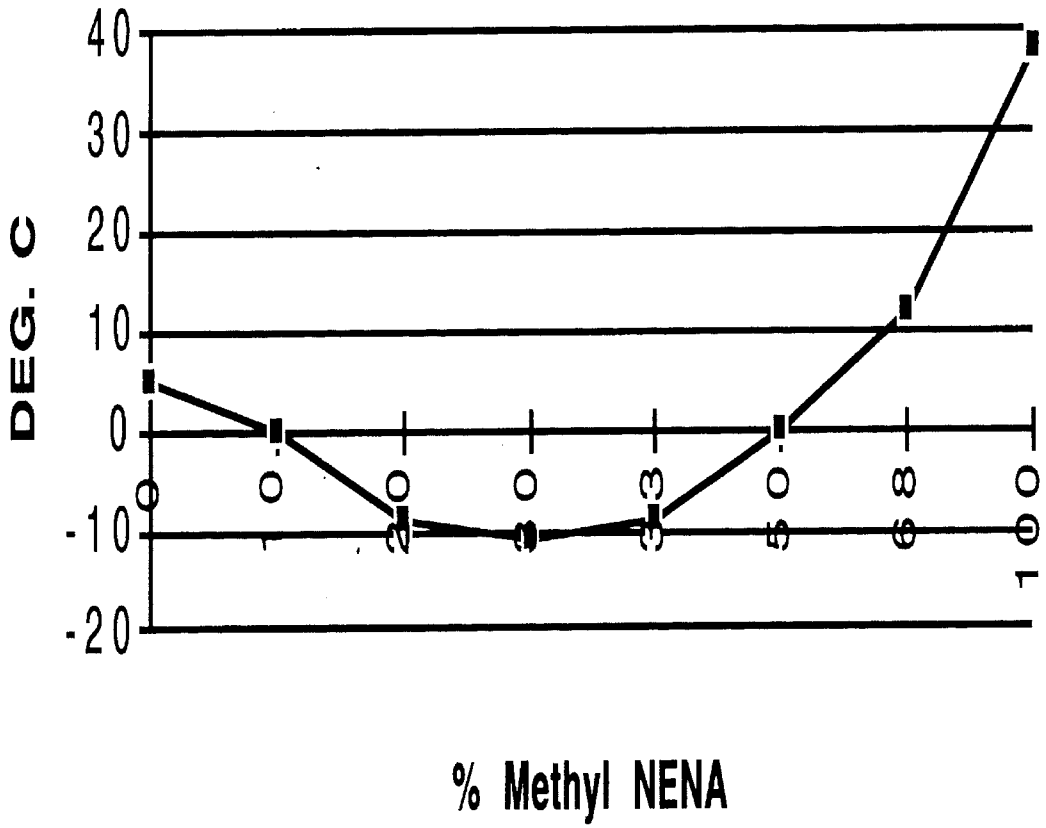

FIG. 5 is an illustration of using mixtures of energetic plasticizers to attain low melting points by taking advantage of eutectic points such as occur with mixtures of methyl and ethyl Nena. It is especially beneficial for the insensitive energetic compositions of the invention to use the combinations of energetic plasticizers which are eutectics or which have depressed melting points so that the matrix can have the maximum lowering of the glass transition temperature and use the maximum percentage of HMX or RDX to attain maximum energy density.

DETAILED DESCRIPTION OF INVENTION AND FIGURES

In the practice of the invention, the insensitive energetic composition is prepared by mixing the RDX or HMX powder with the binder and the plasticizer and this results in clusters of particles of RDX or HMX. The clusters of coated particles of filler are held in a matrix of binder and plasticizer. The matrix material, generally the combination of binder and plasticizer, will have a glass transition temperature of less than 45 Degrees C. An important variation are those compositions in which there are coatings of aluminum powder on the outer surface of the clusters. In these compositions, there will be the aluminum metal component and there will be the organic component. The appropriate proportions for the components are discussed below.

In tabular form, the relative effects of the munition from varying proportions of Aluminum and energetic filler in the explosive composition are:

| ALUMINUM | NITRAMINE FILLER | EFFECT |
|---|---|---|
| High | Low | Maximum Blast Effect |
| Low | High | Maximum Metal Accelerator |
| Medium | Medium | Blast and Acceleration |

The insensitive munitions of the invention are prepared by making the energetic composition, processing the composition into intermediate shapes and fabricating an article from the intermediate shape. The article may itself be directed to military use such as a munition or an ammunition and it may also be directed to civilian uses such as demolition charges.

One such class of munition is demolition or blasting munitions. The compositions of the invention are generally used as an element of a munition or ammunition. In these, the explosive is formed into an article that will have blasting effects when exploded. The explosive article is assembled along with other items, such as propellants, fuzes, guidance systems, etc. into the munition. The munition can be a small caliber bullet, a large caliber shell, a warhead, a rocket, a bomb, a mortar, a torpedo, a mine or similar devices. It can be loaded into a weapon such as an artillery piece, a tank or armored vehicle or a supply vehicle for the artillery piece or tank. The weapon system can be mounted on vehicles, aircraft or ships. The resistance to sympathetic detonation and the effective blasting action of the chemical compositions are major factors in allowing widespread and varied use of the invention. In one example of the useful aspects of the invention, the ammunition can be loaded into an ammunition storage vehicle and this is used to serve the weapon with ammunition. It can be used on a wide variety of platforms used on land and sea and in the air. Thus it can be used in demolitions, mines and countermines. It can be used in tanks, armored vehicles, artillery, surface ships and submarines. The individual components of the insensitive compositions are generally known and available.

In terms of the ingredients and the chemical compositions, the invention is a high energy composition in which crystalline heterocyclic nitramine powder is coated with a combination of cellulose ester binder and an energetic plasticizer that is an alkyl nitrato nitramine or a liquid alkyl nitrate ester. Generally it is prepared by mixing of the powder with the binder and plasticizer to form clusters in which the particles of the powder become coated and are in a matrix of binder and plasticizer. The particles will be in coating to coating contact. One suitable method is known as the solvent-extrusion process; another suitable method is known as the slurry process. These processes have different steps and different intermediate compositions though both provide materials that can be fabricated into articles such as ammunition.

In the solvent-extrusion process, the materials are mixed with a common solvent and devolatized to a dough like condition. This is a highly filled suspension which is extruded into strands and cut into pellets or grains. The grains are solid and can be used in that form or fabricated into an article such as a billet. Both the grain and the article represent consolidated clusters of the insensitive energetic composition of the invention. These will be the explosive component for whatever final article is fabricated. When the article is a billet, it may be assembled into a blasting effect ammunition or munition which can be shells, rockets, torpedoes, mines, countermines etc.

When the slurry process is used, the materials are mixed and suspended in water as a suspension medium. The ingredients form very small spheres and are insoluble in the suspension medium. The suspension is coalesced to recover the spheres. The diameter of the spheres can be in the range of about 0.008 to about 0.04 inches. The spheres can be dried and then can be used in place of grains to form articles. An advantage of this process is that it does not require the steps of extrusion into strands and cutting of the strands into grains. The spheres are another embodiment of the consolidated clusters of the insensitive energetic compositions of the invention.

The matrix material of the invention has a glass transition temperature of less than minus 45 degrees Centigrade. The clusters of the energetic compositions can be processed into intermediate shapes and structures. The intermediate shapes and structures may be used directly in that form or can be fabricated into other articles such as billets that are parts of munitions or ammunitions. The ammunitions can be assembled or carried with weapons and weapon systems.

The crystalline heterocyclic nitramines HMX and RDX are the energetic fillers used in the compositions of the invention. They have very high energy densities and are well established in the field. They have been used in ammunitions and munitions for over fifty years and a very large body of data has been developed for their manufacture and safe use in munitions as both propellants and explosives. HMX and RDX have been type classified and described with military specifications by virtually every country in the world. HMX has a higher energy density than RDX. They are available in the form of fine powders. The HMX is preferably the solid, insensitive variety. One type is described in military specifications as beta HMX, Class 5. This has a mean particle size of about 3 to 5 microns. The solid crystalline RDX will have a similar particle size.

The composition range includes the proportions for the organic component and the proportions for the aluminum metal component. The aluminum metal greatly improves the blasting effects that can be attained with the compositions of the invention. The aluminum is added so that it will form a coating on the clusters of energetic organic component. In the solvent-extrusion process, this can be done by delaying the addition of the aluminum until after most of the volatile vehicle has evaporated from the mixture of energetic filler, binder and energetic plasticizer. The organic component of the composition will be: about 85 to 95% by weight of RDX or HMX, about 2.5% to 9% by weight of binder, and from 2.5% to balance of plasticizer. The metal component will be about 1 to 40% by weight of aluminum and correspondingly 99 to 60 weight % of organic component. A preferred composition range has about 3 to about 20 per cent aluminum. In the organic component, the content of HMX or RDX has a lower limit of about 85% by weight. This lower limit represents the minimum amount to provide an energy density which is at least high enough to have the composition function as an explosive. The upper range is about 87% and this represents the point at which the composition develops increased sensitivity to impact and sympathetic detonation. Above this limit, the risk of unintended detonation and accidental explosion becomes too great.

The solid cellulose ester acts as a non-energetic binder for the composition. It combines with the energetic plasticizer and this constitutes the coating for the HMX or RDX powder. In the solid cellulose esters, a preferred member is cellulose acetate butyrate, these are well established and qualified as binders for HMX and RDX and have been extensively tested in propellant and explosive applications. A typical cellulose acetate butyrate is CAB 381-20, a product sold by the Eastman Kodak company. Other cellulose acetate esters such as cellulose acetate, cellulose acetate propionate and ethyl cellulose may be substituted for the cellulose acetate butyrate. The cellulose acetate ester is preferably used in about 6 to about 9% by weight of the total organic component.

The third major ingredient is the energetic plasticizer. This is a member selected from the nitrato alkyl nitramines and the liquid alkyl nitrates. The nitrato alkyl nitramines are preferably the ethyl nitramines. The preferred members are ethyl nitrato ethyl nitramine known as ethyl Nena, methyl nitrato ethyl nitramine known as methyl Nena and butyl nitrato ethyl nitramine known as butyl Nena. The nitrato alkyl nitramine in liquid form is preferred. Mixtures of solid methyl Nena and liquid ethyl Nena form a liquid eutectic which is used as the energetic plasticizer. Similarly, mixtures of ethyl and butyl Nena can be used as the energetic plasticizer. The mixtures take advantage of the property of the Nena compounds to form low melting point eutectics that simultaneously tend to maximize reduction of glass transition temperature and increase density by maximizing the proportion of energetic filler. This can be seen in the compositions depicted in the Figures.

The other group of energetic plasticizers are the liquid alkyl nitrates. The preferred members are metriol trinitrate (TMETN), triethylene glycol dinitrate (TEGDN), diethylene glycol dinitrate (DEGDN) and butane triol trinitrate (BTTN). These are liquids and have low melting points. When combined with the cellulose acetate ester binder, they also provide matrix materials with glass transition temperatures below minus 45 degrees centigrade. The liquid alkyl nitrates can be used individually or they can be used in combinations.

The energetic plasticizer is used in about 4.5 to about 9% by total weight. The precise proportions of energetic filler, binder and energetic plasticizer are adjusted to get good processability of the intermediate materials, particularly adequate strength in strands that are or will be cut into grains.

Preparation of the compositions by the steps of the solvent extrusion method are generally well known in this field and are as follows. The crystalline nitramine powder is mixed with a volatile vehicle and the solid cellulose acetate ester. The energetic plasticizer is added, the mixture is devolatized to form a moist dough. The dough is extruded into strands, the strands are cut into pellets or grains. The grains are shaped to have length about equal to diameter, and the length is typically about 0.05 to 0.10 inches. The grains are dried. For explosives, the grains are solid and not perforated.

The energetic composition is in transition during preparation. In the solvent-extrusion system, it becomes drier as the volatile vehicle is released and reaches a condition where it is a dough. The dough is fed to the extruder for forming into strands. The strands are cut into pellets or grains; the grains are dried further and later can be pressed into cone shaped members known as billets.

The clusters are formed in the early stages of mixing when the fine powders of RDX or HMX become coated with the combination of cellulose acetate ester binder and energetic plasticizer. As the vehicle evaporates or if slurry coalescence is used, the composition evolves to having a matrix where there is binder and plasticizer which hold the particles of energetic filler. Two or more particles having common matrix material form the basic unit of the cluster. The cluster structure is retained during subsequent processing. By having a low glass transition temperature in the matrix material, the cluster structure in the composition and its articles prevent low temperature brittleness and they can be processed or stored or used at temperatures of down to minus 45 degrees C. It can also be seen that the dough and the moist spheres are highly filled suspensions. Another advantage of the invention is that the decomposition temperature is about 234 degrees C.

FIG. 1 illustrates the invention having RDX, CAB and liquid nitrate esters as the energetic composition. A comparison material known as PAX-2A is shown for reference purposes. Sensitivity is shown as impact sensitivity and sympathetic detonation. Processability is rated. In the recipes, small amounts of finely divided silica are denoted as CAB-O-SIl, a tradename of Cabot Corporation, these significantly improved processability and also improved mold release of the shaped articles formed from the compositions. Also, small amounts of liquid epoxy resins were added to improve processability, these are sold under the tradename Epon 828 by the Eastman Kodak company.

These are liquid, aromatic, bis-phenol materials. It can be seen that the processability was improved. This additive is also beneficial in the solvent extrusion process because it has been found that it improves the strength of the extruded strands and reduces breakage.

FIG. 2 illustrates the invention in which HMX, CAB and the nitrato nitramines are used in the energetic compositions. The respective energetic calculations are shown as well as the processability and the sensitivity. The finely divided silica was used in the recipes with the same benefits as explained for FIG. 1.

FIG. 3 illustrates the invention in which HMX, CAB and liquid nitrate esters are used in the energetic composition of the invention. Minor amounts of nitrocellulose, NC as well as the finely divided silica and the epoxy resin were present. EC was used as well. For reference purposes, the processability, sensitivity and calculated energetic performance relative to PA-2A are shown. It can be seen that the invention provides good performance in these areas as well as the benefits described above for the silica and the epoxy resin.

FIG. 4 illustrates the matrix glass transition points for the matrix materials of nonenergetic binder and energetic plasticizer. The mixtures of liquid nitrate esters demonstrate the benefit of using mixtures that achieve lower glass transition temperature than either component individually.

FIG. 5 illustrates the lowering melting point effect for mixtures of Methyl and Ethyl Nena. The relative depression per unit weight of plasticizer is desirably maximized so that the maximum amount of energetic filler can be used in the composition. For the mixtures shown in FIG. 5, the maximum is between about 20 to about 35 weight per cent of Methyl Nena.

In the calculated effects shown in the FIGURES, the calculations are based on a computer program known as Tiger and which is distributed by the Lawrence Livermore Laboratory.

As a group, the energetic plasticizers of the invention compare very favorably to the present materials such as BDNPA/F. They have lower melting points, lower toxicity, lower vapor pressure, very good plasticizing effect with nitrate ester binders and very low solubility of RDX and HMX. These properties are useful in safe processing and in improving the properties of the articles made from the energetic compositions of the invention. It is to be understood that the present invention is not to be limited to the specific embodiments disclosed herein but is intended to cover such variations as are traditional within the field of the invention.

We claim:

1. An insensitive energetic composition for use as an explosive in munitions, said composition being clusters of coated powder where the powder is a crystalline heterocyclic nitramine and the coating is a combination of a normally solid cellulose acetate ester and at least one member selected from alkyl nitrato nitramine and a liquid alkyl nitrate ester, and where: (a) the crystalline heterocyclic nitramine is HMX or RDX and is the principal energetic filler in the composition and is present in about 85 to about 87% by weight, (b) the acetate ester functions as a nonenergetic binder and the nitramine and the nitrate ester function as energetic plasticizers, and (c) the nitrato nitramine and nitrate ester are selected from the group of Methyl Nena, Ethyl Nena, metriol trinitrate, diethylene glycol dinitrate, triethylene glycol-dinitrate and mixtures thereof and are present in an amount sufficient to provide a glass transition temperature of less than minus 45 degrees Centigrade (–45° C.).

2. An insensitive energetic composition for use as an explosive in munitions, said composition having a maximum theoretical density in the range of about 1.69 to 1.77 and being clusters of coated powder where the powder is a crystalline heterocyclic nitramine and the coating is a combination of a normally solid cellulose acetate ester and at least one member selected from alkyl nitrato nitramine and a liquid alkyl nitrate ester, and where: (a) the crystalline heterocyclic nitramine is HMX or RDX and is the principal energetic filler in the composition and is present in about 85 to about 87% by weight, (b) the acetate ester functions as a nonenergetic binder and the nitramine and the nitrate ester function as energetic plasticizers (c) the nitrato nitramine and nitrate ester are selected from the group of Methyl Nena, Ethyl Nena, metriol trinitrate, diethylene glycol dinitrate, triethylene glycol-dinitrate and mixtures thereof and provide a glass transition temperature of less than minus 45 degrees Centigrade (–45° C.).

* * * * *